US010475462B2

(12) United States Patent
Hodgson et al.

(10) Patent No.: US 10,475,462 B2
(45) Date of Patent: Nov. 12, 2019

(54) AUDIO RECOGNITION APPARATUS AND METHOD

(71) Applicant: PlayFusion Limited, Cambridge (GB)

(72) Inventors: Riaan Hodgson, Northants (GB); David Gomberg, New York, NY (US); Mark Gerhard, Waresley (GB)

(73) Assignee: PLAYFUSION LIMITED, Cambridge (GB)

( * ) Notice: Subject to any disclaimer, the term of this patent is extended or adjusted under 35 U.S.C. 154(b) by 49 days.

(21) Appl. No.: 15/806,401

(22) Filed: Nov. 8, 2017

(65) Prior Publication Data

US 2019/0139557 A1 May 9, 2019

(51) Int. Cl.

*G10L 25/18* (2013.01)
*G10L 19/018* (2013.01)
*G10L 25/51* (2013.01)

(52) U.S. Cl.

CPC ..... *G10L 19/018* (2013.01); *G10L 25/51* (2013.01); *G10L 25/18* (2013.01)

(58) Field of Classification Search

CPC ..... G10L 19/018; G10L 25/18; G10L 25/54; G06F 16/683

USPC ..... 700/94; 704/270; 381/56–57

See application file for complete search history.

(56) References Cited

U.S. PATENT DOCUMENTS

2007/0055500 A1* 3/2007 Bilobrov ..... G10L 25/48 704/217
2015/0142456 A1* 5/2015 Lowe ..... H04H 60/04 704/503
2016/0148620 A1* 5/2016 Bilobrov ..... G10L 25/54 704/270
2017/0296927 A1* 10/2017 Hodgson ..... A63F 13/245

* cited by examiner

*Primary Examiner* — Melur Ramakrishnaiah
(74) *Attorney, Agent, or Firm* — Hauptman Ham, LLP

(57) ABSTRACT

A method includes generating, by a processor, an audio fingerprint representative of an audio signal. The audio fingerprint is based on a plurality of first intensity values corresponding to one or more segments of the audio signal. The plurality of first intensity values are based on a Fast Fourier Transform (FFT) performed on at least one sampled segment of the audio signal. The method also includes comparing a plurality of second intensity values based on a recorded sound to determine whether the second intensity values match the first intensity values. The method additionally includes causing a message to be communicated to a device used to record the sound based on a determination that the plurality of second intensity values match the plurality of first intensity values.

16 Claims, 3 Drawing Sheets

AUDIO RECOGNITION APPARATUS AND METHOD

BACKGROUND

Service providers and device manufacturers are continually challenged to deliver value and convenience to consumers by, for example, providing compelling network services. Performance of sound recognition services and systems is often limited by one or more of ambient noise or processing speeds.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
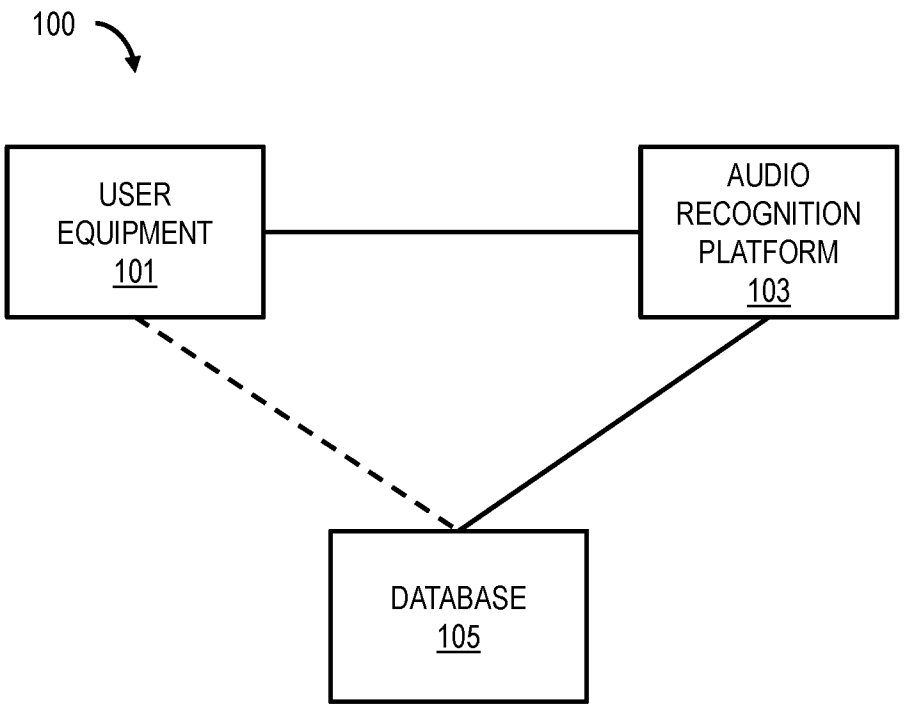
FIG. 1 is a diagram of a system for recognizing an audio signal, in accordance with one or more embodiments.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Game developers, toy manufacturers and media providers are continually challenged to develop new and interesting ways for users to interact with games, toys, television shows, movies, video clips, music, or other consumable media.

FIG. 1 is a diagram of a system 100 for recognizing an audio signal, in accordance with one or more embodiments. System 100 comprises a user equipment (UE) 101 having connectivity to an audio recognition platform 103 and a database 105. The UE 101, audio recognition platform 103 and a database 105 communicate by wired or wireless communication connection and/or one or more networks, or combination thereof.

System 100 is configured to recognize an audio clip in a manner that provides flexibility to account for background interference, provides increased processing speeds and efficiency, and reduces processing burden placed on user devices and network bandwidth.

The UE 101 is a type of mobile terminal, fixed terminal, or portable terminal including a desktop computer, laptop computer, notebook computer, netbook computer, tablet computer, wearable circuitry, mobile device, mobile handset, server, gaming console, gaming controller, or combination thereof.

By way of example, the UE 101, audio recognition platform 103 and database 105 communicate with each other and other components of the communication network 105 using well known, new or still developing protocols. In this context, a protocol includes a set of rules defining how the network nodes within the communication network 105 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Audio recognition platform 103 is a set of computer readable instructions that, when executed by a processor such as a processor 303 (FIG. 3), generates an audio fingerprint representative of an audio signal and compares sound data recorded by the UE 101 to determine if the recorded sound matches the audio fingerprint representative of the audio signal. In some embodiments, audio recognition platform 103 is remote from UE 101. In some embodiments, audio recognition platform 103 is a part of UE 101. In some embodiments, one or more processes the audio recognition platform 103 is configured to perform is divided among UE 101 and a processor remote from UE 101. The audio fingerprint generated by the audio recognition platform 103 is stored in database 105. Database 105 is a memory such as a memory 305 (FIG. 3) capable of being queried or caused to store one or more of an audio fingerprint generated by the audio recognition platform 103, sound data recorded by the UE 101, data associated with the UE 101, or some other suitable information.

Audio recognition platform 103 is configured to process a pre-recorded sound having a duration to generate the audio fingerprint. In some embodiments, the audio recognition platform generates the audio fingerprint based on intensity values corresponding to one or more segments of an audio signal associated with the pre-recorded sound. In some embodiments, the pre-recorded sound is stored in database 105. In some embodiments, the pre-recorded sound is recorded by a UE 101. In some embodiments, the pre-recorded sound is recorded by a device having a processor configured to implement audio recognition platform 103. In some embodiments, the pre-recorded sound is recorded by a device having connectivity to database 105. In some embodiments, the pre-recorded sound is an audio clip of a song, television show, movie, video game, real-world occurrence, user speech, short film or video segment, or some other suitable media having audio content. In some embodiments, the pre-recorded sound has a duration of about 10 seconds. In some embodiments, the pre-recorded sound has a duration greater than 10 seconds and the audio signal upon which the audio fingerprint is based has a duration less than a duration of the pre-recorded sound. In some embodiments, the audio signal upon which the audio fingerprint is based has a duration of 10 seconds. In some embodiments, the audio signal upon which the audio fingerprint is based has some other suitable duration.

To generate the audio fingerprint, audio recognition platform 103 samples the audio signal at a predetermined sampling rate corresponding to a quantity of samples per second in a sound wave. In some embodiments, the predetermined sampling rate is 44,100 Hz (44.1 kHz). As an example, if the audio signal has a duration of 60 seconds, and the sampling rate is 44,100 Hz, the audio recognition platform 103 is configured to generate 2,646,000 samples for 60 seconds of continuous audio. In some embodiments, the audio recognition platform is configured to sample the audio signal at some other suitable sampling rate.

Audio recognition platform 103 segments the sampled audio signal into at least a first frame having a first quantity of samples and a second frame having a second quantity of samples. Audio recognition platform 103 then generates a plurality of first intensity values by performing a Fast Fourier Transform (FFT) on the samples included in the first frame. In some embodiments, the FFT is a windowed FFT. In some embodiments, the audio recognition platform 103 is configured to generate the audio fingerprint by performing the FFT on a plurality of overlapped frames of the audio signal. In some embodiments, audio recognition platform 103 generates a plurality of second intensity values by performing a second FFT on the samples included in the second frame. In some embodiments, the FFT is a windowed triangular FFT performed on the first frame and the second frame by fading-in the first frame of the audio signal and fading-out the second frame of the audio signal such that the first frame and the second frame are mixed to generate a plurality of average intensity values.

In some embodiments, if the audio recognition platform 103 is operating on the audio signal with a sampling frequency of 44,100 Hz, the audio recognition platform 103 performs the FFT on a 2048-sample buffer, generating 1024 intensity and phase values corresponding to frequencies from 0 to 22,050 Hz. Intensity is indicative of the strength/power of a waveform at a point in time, and phase is the point of time on a wave. Phase values are sometimes affected by background acoustics. In some embodiments, audio recognition platform 103 is configured to discard the phase values. In some embodiments, if the FFT is triangular, the audio recognition platforms takes two consecutive 2048-sample runs, fades the first sample in and fades the second one out. The audio recognition platform 103 overlays these two sections and mixes them. In some embodiments, audio recognition platform 103 sums the sections point-wise. Mixing the sample runs creates a periodic signal. In some embodiments, the windowed FFT is a sine shape, or some other suitable shape.

In some embodiments, audio recognition platform 103 identifies a predetermined frequency range having a lowest and highest frequency of interest. In some embodiments, a low end of the predetermined frequency range is 1,000 Hz and a high end of the frequency range is 6,000 Hz. A range of 1,000 Hz to 6,000 Hz is about the range within which the human ear is capable of extracting speech or other perceptible sounds. Audio recognition platform 103 divides the predetermined frequency range into a preset quantity of frequency bands. In some embodiments, the preset quantity of frequency bands comprises 16 frequency bands that broader than the first FFT bands that there are 1024 of. In some embodiments, the preset quantity of frequency bands comprises a different quantity of bands that are broader than the quantity of bands generated by the first FFT. Each frequency band included in the preset quantity of frequency bands has a low end and a high end. The high end of at least one frequency band included in the preset quantity of frequency bands is the low end of a next frequency band of the present quantity of frequency bands.

In some embodiments, audio recognition platform 103 spaces the preset quantity of bands linearly. In some embodiments, audio recognition platform 103 spaces the preset quantity of frequency bands logarithmically rather than linearly in Hz by a predetermined constant 'a', wherein each band is 'a' times the frequency as the last band. Spreading the preset quantity of frequency bands logarithmically makes it possible to extract useful information from the sampled audio signal even when some bands are obscured by an interfering noise, some other distortion or background interference. Logarithmically spreading the preset quantity of bands increases the resiliency of the audio recognition platform's ability to recognize an audio signal despite differing audio sources, and fidelities, including compression, stretching, quality etc.

Audio recognition platform 103 calculates a first and last corresponding FFT band (e.g., the ones there are 1024 of in the above-mentioned example), and then takes all corresponding intensity values and averages them to generate a quantity of intensity values equal to the quantity of frequency bands included in the preset quantity of frequency bands. For example, if the preset quantity of frequency bands comprises 16 broader bands, the audio recognition platform generates 16 intensity values.

In some embodiments, the audio recognition platform 103 calculates the intensity values for a specific time in the audio signal. In some embodiments, the middle of the triangular shape of the FFT is the instant in time that intensity values represent.

The audio recognition platform 103 calculates a set of intensity values for a plurality of overlapping frames. In some embodiments, the audio recognition platform 103 divides the sample size into halves, thirds, quarters, fifths, sixths, or some other suitable quantity and then performs the FFT by cycling through the sampled audio signal one sample-size at a time, advancing frame-by-frame. For example, if the audio recognition platform 103 divides the sample size having buffer size of 2,048 into fourths, the audio recognition platform 103 calculates for a window ¼ of the sample size later (e.g., 512 samples later in time for ¼ of the buffer size of 2,048), and then another one ¼ of the buffer size later still, and so on throughout the entirety of the audio signal. Overlapping the frames makes it possible to prevent a band's intensity value to change suddenly from one time to the next, which improves reliability when cross-correlating a sound recorded by UE 101 with the audio fingerprint generated by audio recognition platform 103.

The audio recognition platform 103 takes the frequency bands one at a time, and normalizes intensity values over time within each band. In some embodiments, if the sound has limited data within a given band, the audio recognition platform 103 normalizes the intensity values for each band by totaling the values. In some embodiments, the audio recognition platform 103 calculates the standard deviation and uses the standard deviation in the normalization calculation. Including the standard deviation in the normalization calculation makes it possible to make the intensity values sensitive to variations. The audio recognition platform 103 then generates a grid of intensity values over time and frequency band (normalized over time per band) to produce the audio fingerprint representative of the audio signal.

UE 101 records a sound by way of a microphone or some other suitable audio sensor included in or having connectivity to UE 101. In some embodiments, UE 101 is always recording sound, or always in a "listening mode." In some embodiments, UE 101 is configured to record sound if based on a location of UE 101, a time of day, a process being performed by UE 101, a proximity of UE 101 to an electronic device, a determination that the UE 101 is communicatively coupled with a device or network, a television schedule, a user instruction, or some other suitable basis for causing the UE 101 to record sound.

In some embodiments, the sound recorded by UE 101 is sampled in real time in a manner that is integrated to a gaming experience within which a user of UE 101 participates. In some embodiments, the sampling of sound recorded by UE 101 is effectively embedded or sampled in a way that minimizes processing load at the UE 101. UE 101 then performs the same calculations as the audio recognition platform 103. In some embodiments, UE 101 performs the same calculation as the audio recognition platform 103 on a recorded sound without performing multiple FFT's over overlapping frames.

In some embodiments, the FFT is a first FFT, and a second FFT is performed on the sound recorded by UE 101 to generate a set of intensity values based on the sound recorded by UE 101. In some embodiments, the second FFT is performed by UE 101, and the set of intensity values based on the sound recorded by UE 101 is communicated to the audio recognition platform 103. In some embodiments, the second FFT is performed by the audio recognition platform 103 and the sound recorded by UE 101 is received by the audio recognition platform 103 from the UE 101.

In some embodiments, UE 101 records sound on a predetermined schedule for a predetermined duration. In some embodiments, the predetermined duration is equal to the duration of the audio signal. In some embodiments, the predetermined duration is equal to a duration of a portion of the audio signal associated with the audio fingerprint. In some embodiments, UE 101 continually records sound on a predetermined schedule for a plurality of sound clips that each have the predetermined duration. In some embodiments, UE 101 is configured to record sound on an open-ended basis, store a quantity of sound clips or intensity values based on the recorded sound, and communicate the sound clips or intensity values to the audio recognition platform 103 on a rolling basis.

In some embodiments, each time a rolling history of intensity values is updated, the UE 101 normalizes the intensity values for each frequency band, and the audio recognition platform 103 compares the normalized intensity values received from the UE 101 with the audio fingerprint by cross-correlation.

In some embodiments, the cross-correlation outputs values from −1 to 1 indicative of a degree to which a graph of intensity values generated based on the sounded recorded by the UE 101 has the same shape (e.g., 1 being the same, −1 being the same but upside down, and 0 or close to 0 being indicative of two unrelated signals).

In some embodiments, because the audio fingerprint is based on overlapping frames, and the rolling history of intensity values based on the sound recorded by the UE 101 is not based on the overlapping frames, the audio recognition platform 103 is capable of stepping through the rolling history faster, taking the first of every four samples, to calculate the cross-correlation compared to an embodiment in which the UE 101 generates the intensity values corresponding to the sound recorded by the UE 101 that are based on overlapping frames. In some embodiments, audio recognition platform 103 performs the cross-correlation for the second, third and fourth of every four sets of intensity values for each clip of recorded sound and takes the clip having the greatest cross-correlation result.

In some embodiments, the audio recognition platform 103 compares the results of the cross correlation for each band against a predetermined threshold value. In some embodiments, the predetermined threshold value is 0.5 or some other suitable value. If the predetermined threshold value is 0.5, the sound recorded by UE 101 is halfway toward being the same as the audio fingerprint, taking all bands into account. In some embodiments, the audio recognition platform 103 determines the recorded sound matches the audio fingerprint if the comparison based on the cross-correlation is equal to or greater than the predetermined threshold value. For example, if the predetermined threshold value is 0.5 and the cross-correlation result is greater than 0.5, the input is halfway toward being the same as the audio fingerprint, and audio recognition platform 103 identifies the recorded sound as matching the audio fingerprint.

Based on a determination that the plurality of second intensity values match the plurality of first intensity values, the audio recognition platform 103 causes a message to be communicated to the UE 101. In some embodiments, the message communicated to the UE 101 comprises a prompt to interact with the UE 101. In some embodiments, the message is a reward or incentive to interact with the UE 101. In some embodiments, the reward or incentive is in the context of a video game. In some embodiments, the reward or incentive is a real-world value associated with money, a promotional product or other suitable commercial benefit. In some embodiments, audio recognition platform 103 is configured to cause a reward to be delivered in real time without the audio clip recorded by UE 101 being finished. In some embodiments, the prompt or message is a light or sound that is output by UE 101 or a peripheral device having connectivity to UE 101. In some embodiments, the prompt or message comprises one or more of sounds, vibrating, or initiating a change in the context of a video game based on a recognized event in the television show, movie, or video game, wherein the recognized event is determined based on a matching of the audio fingerprint. In some embodiments, audio recognition platform 103 is configured to trigger an event to occur in a video game based on a determined that the sound recorded by UE 101 matches at least one audio fingerprint stored in database 105. In some embodiments, audio recognition platform 103 is configured to cause a change in state or function of UE 101 or a peripheral device having connectivity to UE 101 based on a determination that the sound recorded by UE 101 matches at least one of the audio fingerprints stored in database 105.

In some embodiments, the pre-recorded sound is directly related to a theme associated with the UE 101 or an application run by or accessible by way of the UE 101 such as a video game. For example, if the UE 101 or the application run by or accessible by way of the UE 101 is directly related to a character "X" or plot "Y," then the pre-recorded sound is based on a video game, song, television show, movie, real-world occurrence, user speech, short film or video segment, or some other suitable media having audio content that includes, describes, references, associates, involves, or is otherwise related to character "X" or plot "Y." In some embodiments, the pre-recorded sound is unrelated to a theme associated with the UE 101 or an application run by or accessible by way of the UE 101 such as a video game. For example, if the UE 101 or the application run by or accessible by way of the UE 101 is unrelated to a character "X" or a plot "Y," then the pre-recorded sound is based on a video game, song, television show, movie, real-world occurrence, user speech, short film or video segment, or some other suitable media having audio content that includes, describes, references, associates, involves, or is otherwise related to a different character or plot such as character "A" or plot "C."

In some embodiments, audio recognition platform 103 is configured to encourage the user to engage in a mixed media engagement, or connected play, so that the user is encouraged to consume multiple media sources at the same time by providing a user with benefits in one media source, e.g., a game or a toy, in exchange for consuming another, e.g. a cartoon/film/video. System 100 makes it possible to provide an automated feedback loop so that if a user consumes a media source, the user receives a gameplay benefit. System 100 provides new ways of enhancing a user's experience interacting with a video game or media content, and provides additional avenues for increasing user interaction with video game content by directing the user to consume additional content outside of an initial game play or product experience. In some embodiments, audio recognition platform 103 is configured to initiate a multi-point reward that incentivizes a user of UE 101 to encourage other users to interact with his or her own UE 101, with an audio clip, with a video game, with a television show, or with some other suitable media source.

In some embodiments, one or more audio fingerprints generated by audio recognition platform 103 are securely stored in the database 105 such that the audio fingerprints are accessible by the audio recognition platform 103 and the audio fingerprints are isolated from the UE 101. The UE 101 is configured to communicate the rolling history to the audio recognition platform 103 for match determination. In some embodiments, if the audio recognition platform 103 is remote from the UE 101, the communication of the rolling history to the audio recognition platform 103 for the comparison helps to minimize processing load at the UE 101, and increases an overall security level of the system 100. In some embodiments, the UE 101 is configured to stream recorded sound to the audio recognition platform 103 for processing and storage. In some embodiments, the rolling history is stored by the UE 101. In some embodiments, the rolling history is stored in database 105.

In some embodiments, audio recognition platform 103 is configured to add a feature to UE 101 without burdening the processing power of UE 101, reducing impact on battery life, UE 101 performance, or compatibility. In some embodiments, audio recognition platform 103 is configured to remotely update UE 101 or database 105. Remotely updating UE 101 or database 105 makes it possible to dynamically update UE 101 or database 105 in real time to account for new media, new audio signals, and future broadcasts.

In some embodiments, audio recognition platform 103 is configured to be time and geography customized or limited such that a user of UE 101 is able to benefit from the output of an audio clip within predetermined parameters. In some embodiments, audio recognition platform 103 is configured to provide marketing capabilities at specific times or places to induce user behavior around parameters that are relevant to a content developer or service provider.

In some embodiments, audio recognition platform 103 is configured to update the audio fingerprint based on determined comparison results to enhance the quality of the audio fingerprint or the accuracy of a comparison for determining a match.

In some embodiments, audio recognition platform 103 is configured to store and process data usable to determine how often a clip is listened to, how often a message is triggered, a quantity of users that are using the system 100, how many users achieve a positive match, how many users use the system 100 but do not achieve a positive match, or some other suitable metric. In some embodiments, audio recognition platform 103 is configured to indicate the popularity of a feature or audio signal based on the stored data.

Figure 2:
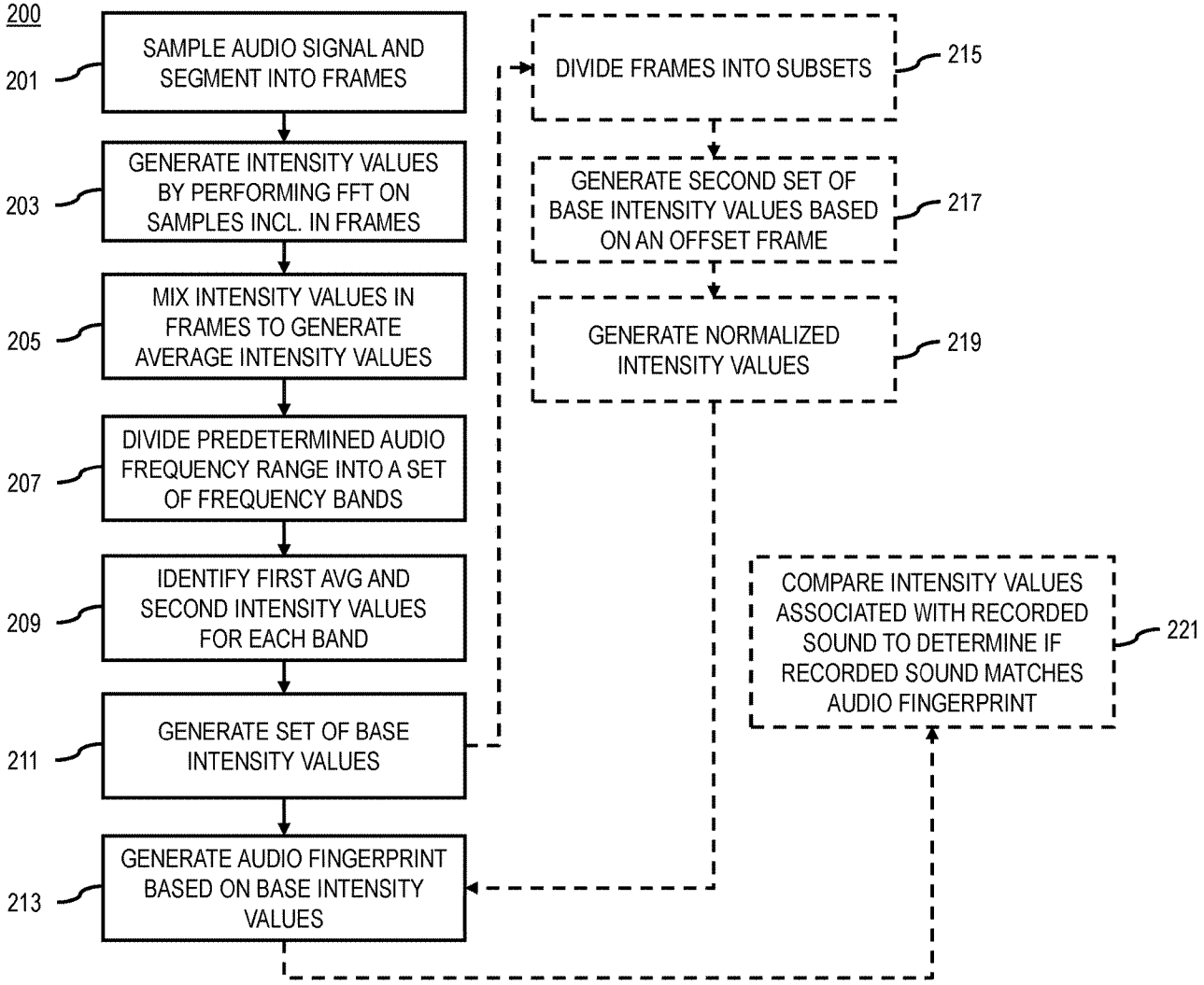
FIG. 2 is a flowchart of a method of recognizing an audio signal, in accordance with one or more embodiments.

FIG. 2 is a flowchart of a method 200 of recognizing an audio signal, in accordance with one or more embodiments. In some embodiments, method 200 is performed by audio recognition platform 103 (FIG. 1).

In step 201, audio recognition platform 103 samples an audio signal at a sampling rate. Audio recognition platform 103 then segments the sampled audio signal into at least a first frame having a first quantity of samples and a second frame having a second quantity of samples. In some embodiments, audio recognition platform 103 samples the audio signal at a sampling rate if 44,100 Hz. In some embodiments, the first quantity of samples included in the first frame is 2,048 and the second quantity of samples included in the second frame is 2,048.

In step 203, audio recognition platform 103 generates a plurality of first intensity values by performing a first FFT on the samples included in the first frame, and a plurality of second intensity values by performing a second FFT on the samples included in the second frame. In some embodiments, the plurality of first intensity values includes 1,024 intensity values and the plurality of second intensity values includes 1,024 intensity values.

In step 205, audio recognition platform 103 mixes the plurality of first intensity values and the plurality of second intensity values to generate a plurality of average intensity values.

In step 207, audio recognition platform 103 divides a predetermined audio frequency range into a set of frequency bands. Each frequency band of the set of frequency bands has a low end and a high end. The high end of at least one frequency band of the set of frequency bands is the low end of a next frequency band of the set of frequency bands. In some embodiments, the predetermined audio frequency range is 1,000 Hz to 6,000 Hz. In some embodiments, the predetermined audio frequency range is divided into 16 frequency bands. In some embodiments, the predetermined audio frequency range is divided into the set of frequency bands by spacing the frequency bands of the set of frequency bands logarithmically.

In step 209, audio recognition platform 103 identifies, for each frequency band of the set of frequency bands, a first average intensity value of the plurality of average intensity values closest to the low end of a corresponding frequency band and a second average intensity value of the plurality of average intensity values closest to the high end of the corresponding frequency band.

In step 211, audio recognition platform 103 generates a set of base intensity values comprising a quantity of values equal to a quantity of frequency bands included in the set of frequency bands by averaging the first average intensity value and the second average intensity value corresponding to each frequency band of the set of frequency bands. In some embodiments, the audio signal has a duration greater than or equal a duration of the first frame added to a duration of the second frame, base intensity values are generated for an entirety of the duration of the audio signal, and the audio fingerprint is based on the entirety of the audio signal.

In step 213, an audio fingerprint is generated that represents the audio signal based on the set of base intensity values.

In some embodiments, the set of base intensity values is a first set of base intensity values. Method 200 optionally comprises steps 215-219. In step 215, audio recognition platform 103 divides the first frame into a plurality of first sub-sets and the second frame into a plurality of second-subsets.

In step 217, audio recognition platform 103 generates a second set of base intensity values is based on an offset frame of the sampled audio signal. The offset frame comprises at least one second-subset of the plurality of second sub-sets and at least one first sub-set of the plurality of first sub-sets. A quantity of the at least one first sub-set included in the first offset frame is equal to a total quantity of first sub-sets of the plurality of first sub-sets included in the first frame of the sampled audio signal minus a quantity of the at least one second sub-set included in the offset frame.

In step 219, audio recognition platform 103 generates a set of normalized intensity value by averaging the first set of base intensity values and the second set of base intensity values. In some embodiments, the audio fingerprint is based on the set of normalized intensity values.

In some embodiments, method 200 optionally comprises step 221 in which audio recognition platform 103 compares a set of third intensity values associated with a sound recorded by a user device such as UE 101 (FIG. 1) to the base intensity values, or the normalized intensity values, upon which the audio fingerprint is based, to determine if the recorded sound upon which the set of third intensity values is based matches the audio fingerprint. In step 221, if the recorded sound matches the audio fingerprint, the audio recognition platform 103 causes a message, prompt, or other suitable indicator to be output to the device used to record the sound or having connectivity to a device used to record the sound. In some embodiments, the device used to record the sound is remote from audio recognition platform 103. In some embodiments, the recorded sound has a duration equal to a duration of the audio signal. In some embodiments sound is recorded on a rolling basis for a plurality of periods of time equal to the duration of the audio signal, and the audio recognition platform 103 periodically receives one or more sets of third intensity values corresponding to each period of time for which sound is recorded to facilitate the comparison.

Figure 3:
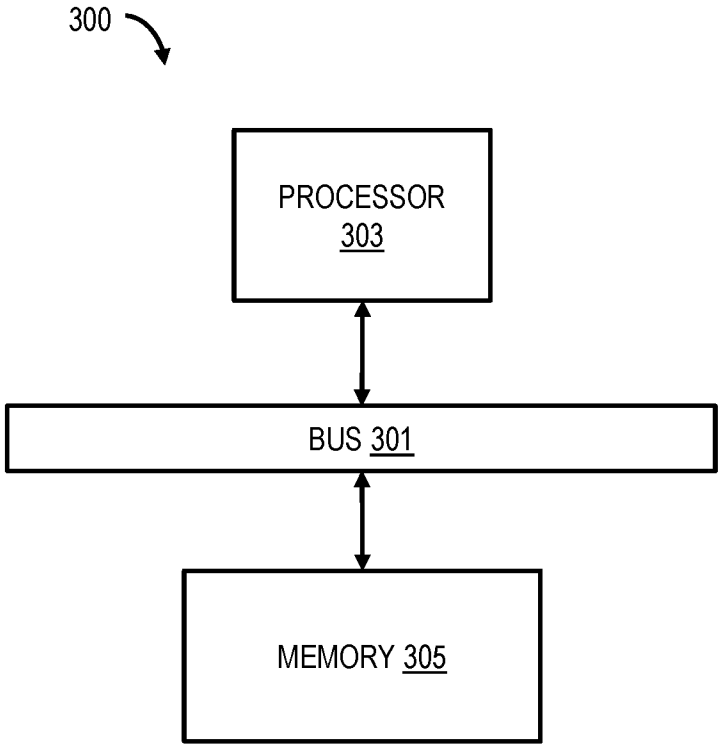
FIG. 3 is a functional block diagram of a computer or processor-based system upon which or by which an embodiment is implemented.

FIG. 3 is a functional block diagram of a computer or processor-based system 300 upon which or by which an embodiment is implemented.

Processor-based system 300 is programmed to one or more of generate an audio fingerprint or compare a recorded sound to an audio fingerprint as described herein, and includes, for example, bus 301, processor 303, and memory 305 components.

In some embodiments, the processor-based system is implemented as a single "system on a chip." Processor-based system 300, or a portion thereof, constitutes a mechanism for performing one or more steps of one or more of generating an audio fingerprint or comparing a recorded sound to an audio fingerprint for recognizing an audio signal.

In some embodiments, the processor-based system 300 includes a communication mechanism such as bus 301 for transferring information and/or instructions among the components of the processor-based system 300. Processor 303 is connected to the bus 301 to obtain instructions for execution and process information stored in, for example, the memory 305. In some embodiments, the processor 1003 is also accompanied with one or more specialized components to perform certain processing functions and tasks such as one or more digital signal processors (DSP), or one or more application-specific integrated circuits (ASIC). A DSP typically is configured to process real-world signals (e.g., sound) in real time independently of the processor 303. Similarly, an ASIC is configurable to perform specialized functions not easily performed by a more general purpose processor. Other specialized components to aid in performing the functions described herein optionally include one or more field programmable gate arrays (FPGA), one or more controllers, or one or more other special-purpose computer chips.

In one or more embodiments, the processor (or multiple processors) 303 performs a set of operations on information as specified by a set of instructions stored in memory 305 related to one or more of generating an audio fingerprint or comparing a recorded sound to an audio fingerprint for recognizing an audio signal. The execution of the instructions causes the processor to perform specified functions.

The processor 303 and accompanying components are connected to the memory 305 via the bus 301. The memory 305 includes one or more of dynamic memory (e.g., RAM, magnetic disk, writable optical disk, etc.) and static memory (e.g., ROM, CD-ROM, etc.) for storing executable instructions that when executed perform the steps described herein to one or more of generate an audio fingerprint or compare a recorded sound to an audio fingerprint for recognizing an audio signal. The memory 305 also stores the data associated with or generated by the execution of the steps.

In one or more embodiments, the memory 305, such as a random access memory (RAM) or any other dynamic storage device, stores information including processor instructions for one or more of generating an audio fingerprint or comparing a recorded sound to an audio fingerprint for recognizing an audio signal. Dynamic memory allows information stored therein to be changed by system 300. RAM allows a unit of information stored at a location called a memory address to be stored and retrieved independently of information at neighboring addresses. The memory 305 is also used by the processor 303 to store temporary values during execution of processor instructions. In various embodiments, the memory 305 is a read only memory (ROM) or any other static storage device coupled to the bus 301 for storing static information, including instructions, that is not changed by the system 300. Some memory is composed of volatile storage that loses the information stored thereon when power is lost. In some embodiments, the memory 305 is a non-volatile (persistent) storage device, such as a magnetic disk, optical disk or flash card, for storing information, including instructions, that persists even when the system 300 is turned off or otherwise loses power.

The term "computer-readable medium" as used herein refers to any medium that participates in providing information to processor 303, including instructions for execution. Such a medium takes many forms, including, but not limited to computer-readable storage medium (e.g., non-volatile media, volatile media). Non-volatile media includes, for example, optical or magnetic disks. Volatile media include, for example, dynamic memory. Common forms of computer-readable media include, for example, a floppy disk, a flexible disk, a hard disk, a magnetic tape, another magnetic medium, a CD-ROM, CDRW, DVD, another optical medium, punch cards, paper tape, optical mark sheets, another physical medium with patterns of holes or other optically recognizable indicia, a RAM, a PROM, an EPROM, a FLASH-EPROM, an EEPROM, a flash memory, another memory chip or cartridge, or another medium from which a computer can read. The term computer-readable storage medium is used herein to refer to a computer-readable medium.

An aspect of this description is related to a method comprising generating, by a processor, an audio fingerprint representative of an audio signal. The audio fingerprint is based on a plurality of first intensity values corresponding to one or more segments of the audio signal. The plurality of first intensity values are based on a Fast Fourier Transform (FFT) performed on at least one sampled segment of the audio signal. The method also comprises comparing a plurality of second intensity values based on a recorded sound to determine whether the second intensity values match the first intensity values. The method additionally comprises causing a message to be communicated to a device used to record the sound based on a determination that the plurality of second intensity values match the plurality of first intensity values.

Another aspect of this description is related to a method, comprising sampling an audio signal at a sampling rate. The method also comprises segmenting the sampled audio signal into at least a first frame having a first quantity of samples and a second frame having a second quantity of samples. The method further comprises generating a plurality of first intensity values by performing a first Fast Fourier Transform (FFT) on the samples included in the first frame. The method additionally comprises generating a plurality of second intensity values by performing a second FFT on the samples included in the second frame. The method also comprises mixing the plurality of first intensity values and the plurality of second intensity values to generate a plurality of average intensity values. The method further comprises dividing a predetermined audio frequency range into a set of frequency bands. Each frequency band of the set of frequency bands has a low end and a high end. The high end of at least one frequency band of the set of frequency bands is the low end of a next frequency band of the set of frequency bands. The method additionally comprises identifying, for each frequency band of the set of frequency bands, a first average intensity value of the plurality of average intensity values closest to the low end of a corresponding frequency band and a second average intensity value of the plurality of average intensity values closest to the high end of the corresponding frequency band. The method also comprises generating a set of base intensity values comprising a quantity of values equal to a quantity of frequency bands included in the set of frequency bands by averaging the first average intensity value and the second average intensity value corresponding to each frequency band of the set of frequency bands. The method further comprises generating an audio fingerprint representative of the audio signal based on the set of base intensity values.

A further aspect of this description is related to an apparatus comprising a processor and a memory having computer executable instructions stored thereon that, when executed by the processor, cause the apparatus to sample an audio signal at a sampling rate. The apparatus is also caused to segment the sampled audio signal into at least a first frame having a first quantity of samples and a second frame having a second quantity of samples. The apparatus is further caused to generate a plurality of first intensity values by performing a first Fast Fourier Transform (FFT) on the samples included in the first frame. The apparatus is additionally caused to generate a plurality of second intensity values by performing a second FFT on the samples included in the second frame. The apparatus is also caused to mix the plurality of first intensity values and the plurality of second intensity values to generate a plurality of average intensity values. The apparatus is further caused to divide a predetermined audio frequency range into a set of frequency bands. Each frequency band of the set of frequency bands has a low end and a high end. The high end of at least one frequency band of the set of frequency bands is the low end of a next frequency band of the set of frequency bands. The apparatus is further caused to identify, for each frequency band of the set of frequency bands, a first average intensity value of the plurality of average intensity values closest to the low end of a corresponding frequency band and a second average intensity value of the plurality of average intensity values closest to the high end of the corresponding frequency band. The apparatus is also caused to generate a set of base intensity values comprising a quantity of values equal to a quantity of frequency bands included in the set of frequency bands by averaging the first average intensity value and the second average intensity value corresponding to each frequency band of the set of frequency bands. The apparatus is further caused to generate an audio fingerprint representative of the audio signal based on the set of base intensity values.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

generating, by a processor, an audio fingerprint representative of an audio signal, the audio fingerprint being based on a plurality of first intensity values corresponding to one or more segments of the audio signal, the plurality of first intensity values being based on a Fast Fourier Transform (FFT) performed on at least one sampled segment of the audio signal;

comparing a plurality of second intensity values based on a recorded sound to determine whether the second intensity values match the first intensity values; and causing a message to be communicated to a device used to record the sound based on a determination that the plurality of second intensity values match the plurality of first intensity values, wherein generating the audio fingerprint further comprises performing the FFT on a plurality of overlapped frames of the audio signal, the second intensity values of the plurality of second intensity values are generated free from a calculation involving overlapped frames, and the device used to record the sound is remote from the processor, and the comparison is performed by the processor.

2. The method of claim 1, wherein the FFT is a first FFT, and the method further comprises:

generating the second intensity values of the plurality of second intensity values by performing a second FFT on the recorded sound.

3. The method of claim 2, wherein the second FFT is performed by the device used to record the sound, and the second intensity values of the plurality of second intensity values are communicated to the processor for comparison.

4. The method of claim 2, wherein the second FFT is performed by the processor, and the recorded sound is received by the processor from the device used to record the sound.

5. The method if claim 1, wherein the audio signal has a first duration, and the recorded sound has a second duration equal to the first duration.

6. The method of claim 1, wherein the FFT is a triangular FFT performed on a first segment and a second segment of the audio signal that are mixed by fading-in the first segment of the audio signal and fading-out the second segment of the audio signal.

7. The method of claim 1, wherein the message communicated to the device used to record the sound comprises a prompt to interact with the device used to record the sound.

8. A method, comprising:

sampling an audio signal at a sampling rate;

segmenting the sampled audio signal into at least a first frame having a first quantity of samples and a second frame having a second quantity of samples;

generating a plurality of first intensity values by performing a first Fast Fourier Transform (FFT) on the samples included in the first frame;

generating a plurality of second intensity values by performing a second FFT on the samples included in the second frame;

mixing the plurality of first intensity values and the plurality of second intensity values to generate a plurality of average intensity values;

dividing a predetermined audio frequency range into a set of frequency bands, wherein each frequency band of the set of frequency bands has a low end and a high end, and the high end of at least one frequency band of the set of frequency bands is the low end of a next frequency band of the set of frequency bands;

identifying, for each frequency band of the set of frequency bands, a first average intensity value of the plurality of average intensity values closest to the low end of a corresponding frequency band and a second average intensity value of the plurality of average intensity values closest to the high end of the corresponding frequency band;

generating a set of base intensity values comprising a quantity of values equal to a quantity of frequency bands included in the set of frequency bands by averaging the first average intensity value and the second average intensity value corresponding to each frequency band of the set of frequency bands;

generating an audio fingerprint representative of the audio signal based on the set of base intensity values, wherein generating the audio fingerprint comprises performing the first FFT on a plurality of overlapped frames of the audio signal, comparing a set of third intensity values to the base intensity values to determine if a recorded sound upon which the set of third intensity values is based matches the audio fingerprint; and causing a message to be output by the device remote from the computer based on a determination that the recorded sound matches the audio fingerprint, wherein the sound is recorded by a device remote from a computer used to determine if the recorded sound matches the audio fingerprint, and the third intensity values of the plurality of third intensity values are generated free from a calculation involving overlapped frames.

9. The method of claim 8, wherein the set of base intensity values is a first set of base intensity values, and the method further comprises:

dividing the first frame into a plurality of first sub-sets and the second frame into a plurality of second-subsets;

generating a second set of base intensity values based on an offset frame of the sampled audio signal, the offset frame comprising at least one second-subset of the plurality of second sub-sets and at least one first sub-set of the plurality of first sub-sets, wherein a quantity of the at least one first sub-set included in the first offset frame is equal to a total quantity of first sub-sets of the plurality of first sub-sets included in the first frame of the sampled audio signal minus a quantity of the at least one second sub-set included in the offset frame; and generating a set of normalized intensity values by averaging the first set of base intensity values and the second set of base intensity values, wherein the audio fingerprint is based on the set of normalized intensity values.

10. The method of claim 8, wherein the predetermined audio frequency range is 1,000 Hz to 6,000 Hz.

11. The method of claim 8, wherein the sampling rate is 44,100 Hz, the first quantity of samples included in the first frame is 2,048, the second quantity of samples included in the second frame is 2,048, the plurality of first intensity values includes 1,024 intensity values, the plurality of second intensity values includes 1,024 intensity values.

12. The method of claim 11, wherein the predetermined audio frequency range is divided into 16 frequency bands.

13. The method of claim 8, wherein the predetermined audio frequency range is divided into the set of frequency bands by spacing the frequency bands of the set of frequency bands logarithmically.

14. The method of claim 8, wherein the audio signal has a duration greater than or equal a duration of the first frame added to a duration of the second frame, and the method further comprises:

generating base intensity values for an entirety of the duration of the audio signal, wherein the audio fingerprint is based on the entirety of the audio signal.

15. The method of claim 8, wherein the recorded sound has a duration equal to a duration of the audio signal.

16. The method of claim 15, wherein the sound is recorded on a rolling basis for a plurality of periods of time equal to the duration of the audio signal, and the method further comprises:

periodically receiving one or more sets of third intensity values corresponding to each period of time for which sound is recorded.

* * * * *